United States Patent [19]

Stumpp et al.

[11] 4,099,505

[45] Jul. 11, 1978

[54] FUEL INJECTION SYSTEM

[75] Inventors: Gerhard Stumpp, Stuttgart; Wolf Wessel, Oberriexingen; Volkard Stein, Stuttgart, all of Germany

[73] Assignee: Robert Bosch GmbH, Stuttgart, Germany

[21] Appl. No.: 694,984

[22] Filed: Jun. 11, 1976

[30] Foreign Application Priority Data

Jul. 3, 1975 [DE] Fed. Rep. of Germany ..... 2529701

[51] Int. Cl.[2] ..... F02M 69/00

[52] U.S. Cl. ..... 123/139 AW; 123/119 EE; 123/139 BG; 261/44 R; 261/44 A; 261/50 A

[58] Field of Search .... 123/119 R, 139 AW, 139 BG, 123/119 EE; 261/44 R, 44 A, 50 R, 50 A, 62, 78 R, DIG. 39

[56] References Cited

U.S. PATENT DOCUMENTS

| | | | |
|---|---|---|---|
| 1,243,250 | 10/1917 | Brinkman | 261/44 R |
| 1,411,426 | 4/1922 | Edwards | 261/44 A |
| 2,798,705 | 7/1957 | Lawrence, Sr. | 261/44 R |
| 2,962,015 | 11/1960 | Serruys et al. | 123/103 R X |
| 2,995,349 | 8/1961 | Kennedy, Sr. | 261/44 A UX |
| 3,809,036 | 5/1974 | Knapp et al. | 123/119 R |
| 3,972,314 | 8/1976 | Dupont et al. | 123/139 AW |

FOREIGN PATENT DOCUMENTS

| | | | |
|---|---|---|---|
| 427,878 | 4/1926 | Fed. Rep. of Germany | 261/41 R |
| 238,980 | 9/1925 | United Kingdom | 261/44 A |
| 194,842 | 3/1923 | United Kingdom | 261/62 |

*Primary Examiner*—Charles J. Myhre
*Assistant Examiner*—Tony M. Argenbright
*Attorney, Agent, or Firm*—Edwin E. Greigg

[57] ABSTRACT

A fuel injection system for an internal combustion engine includes an air flow responsive throttle element in the induction tube which is subject to an adjustable elastic restoring force. The throttle element is attached to a bushing which rotates about a pivotal shaft mounted within the induction tube. A control slot in the bushing is covered to varying extent by a control edge on the pivotal shaft so that fuel which enters a groove in the shaft is metered out according to the relative rotation of shaft and bushing. The relative position of the throttle can be adjusted by a pressure cell.

16 Claims, 5 Drawing Figures

FUEL INJECTION SYSTEM

BACKGROUND OF THE INVENTION

The invention relates to a fuel injection system for mixture compressing externally ignited internal combustion engines. The type of engine to which this invention especially relates has an injection location in the air induction manifold.

The free flow aperture of the induction tube can be varied by means of an arbitrarily movable throttle element which also displaces the movable part of a fuel metering valve.

Fuel injection systems of this type are employed to obtain an automatic favorable adjustment of fuel-air mixture for all operational conditions of the engine so as to obtain complete combustion of fuel and the highest power or lowest fuel consumption. In addition, the concentration of toxic components in the exhaust gas is sharply reduced or entirely absent. This type of control requires that the fuel quantity be metered out very precisely according to the engine requirements.

In known fuel injection systems of this general type, the air quantity flowing through the induction tube is measured by an air flow rate meter and fuel is metered out proportional to the air quantity separately for each engine cylinder and is injected separately by individual injection valves in the vicinity of each cylinder. An embodiment of this type of fuel injection system is very expensive and complicated.

OBJECT AND SUMMARY OF THE INVENTION

It is a principle object of this invention to provide a fuel injection system similar to the known type but involving substantially lower constructional costs and providing a substantially improved fuel-air mixture while fulfilling the above-cited requirements made of such a fuel injection system.

This object is attained according to the invention by providing that the throttle element is a rotating slide pivotably mounted at one end in the induction tube and penetrating the induction tube transversely. Opposite the pivotal shaft, the rotating slide has a substantially cylindrical circumference which cooperates with a portion of the induction tube to open a flow aperture to a greater or lesser degree. The rotational position of the throttling element is determined arbitrarily by the vehicle operator acting on his accelerator pedal. The motion of the accelerator pedal is transmitted to the throttling element by a series of linkages. The precise relative position of the throttling element may also be adjusted in dependence or the static pressure prevailing in the narrowest flow aperture as between the throttling element and the induction tube wall. The invention further provides that the fuel metering valve assembly is disposed within the bearing shaft of the throttling element and further provides that the metered out fuel quantity is injected into the air induction tube upstream of the narrowest flow aperture.

An advantageous feature of the invention is that the throttling element and the wall of the induction tube are so embodied that the air flowing through the narrowest flow aperture has sonic velocity.

Yet another advantageous feature of the invention is that there is provided a pressure-sensitive element which engages the linkage between the accelerator pedal and the throttling element for correcting the position of the latter as a function of the static pressure prevailing in the narrowest flow cross section. The pressure-sensitive element includes a diaphragm which experiences, on one side, induction tube pressure upstream of the throttling element and, on the other side, it is exposed to the static pressure in the narrow gap between the throttling element and the induction tube wall as well as the force of a spring.

Yet another advantageous feature of the invention provides that, when the static pressure in the narrow gap is substantially higher than is the case at sonic velocity, the gap may be narrowed further by the action of the pressure-sensitive element which engages the actuating linkage and rotates the throttling element.

In yet another advantageous feature of the invention, the linkage which transmits the motion of the accelerator pedal to the throttling element is a system of levers.

Yet another advantageous embodiment of the invention provides that the transmission of the motion of the accelerator pedal to the throttling element is a system of racks and pinions. In that case, the actuating lever attached to the pressure-sensitive element is provided with a gear which engages a first rack displaced by the accelerator pedal and a second rack, which engages a gear attached to the throttling element.

The invention will be better understood as well as further objects and advantages thereof become more apparent from the ensuing detailed description of two exemplary embodiments taken in conjunction with the drawing.

DESCRIPTION OF THE PREFERRED EMBODIMENTS

Figure 1:
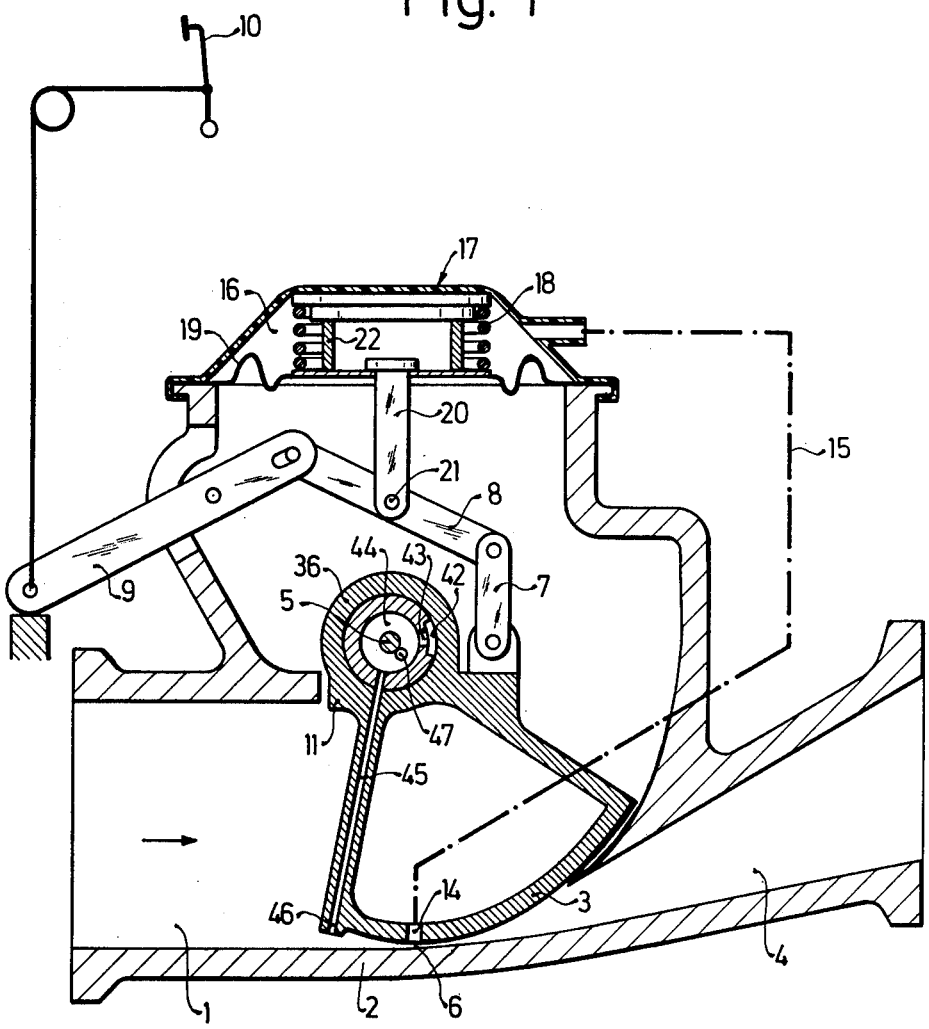
FIG. 1 is a section through a first exemplary embodiment of a fuel injection system according to the invention, taken along the line I—I in FIG. 2.

Turning now to FIG. 1, there is shown the first exemplary embodiment of a fuel injection system according to the invention in which combustion air flows in the direction of the arrow through an induction tube 1 which includes a region 2 and a throttle element 3 disposed therein. The air further flows through a diffusing region 4 to one or several cylinders (not shown) of an internal combustion engine.

The throttle element 3 is pivotably mounted on one side about a shaft 5 mounted transversely and fixedly in the induction tube. The throttle element is a rotating slide which is configured substantially cylindrically in the region opposite the bearing shaft 5. The cylindrical region of the throttle element 3 cooperates with an appropriately configured region 2 of the air induction line 1 to define a narrowest flow aperture 6 which is opened to a greater or lesser degree depending on the rotational position of the throttle element 3. It may be advantageous for reasons of cost and weight savings to make the throttle element 3 hollow. The throttle element 3 is actuated by the accelerator pedal 10 acting via a system of levers 7,8,9. A stop 11 limits the rotational motion of the throttling element 3 in the clockwise sense. The throttle element 3 substantially obturates the air induction tube 1 in the vicinity of the region 2, leaving only a narrow flow aperture 6 which may be enlarged by rotation of the throttle element 3 in the counterclockwise sense. The flow aperture 6 may be so narrow that the air traversing it flows at sonic velocity. Thus, when the air pressure upstream of the throttle element 3 is constant, the aspirated air quantity depends only on the magnitude of the flow aperture 6. The tube profile downstream of the aperture 6 is embodied as a diffusor 4 so as to reduce pressure and power losses to a minimum.

The cylindrical wall of the throttle element 3 is provided with an opening 14 through which the static pressure prevailing in the narrow gap 6 can be sensed and transmitted through a line 15 to a chamber 16 within a diaphragm pressure box 17. The chamber 16 also includes a spring 18 which acts against a diaphragm 19 that seals the chamber 16 from the induction tube pressure prevailing upstream of the throttle element 3. Attached to the diaphragm 19 is an actuating arm 20 whose end remote from the diaphragm has a bearing shaft 21 about which a lever 8 is pivotably affixed. The motion of the diaphragm 19 away from the spring 18 is limited by a ring 22.

Figure 2:
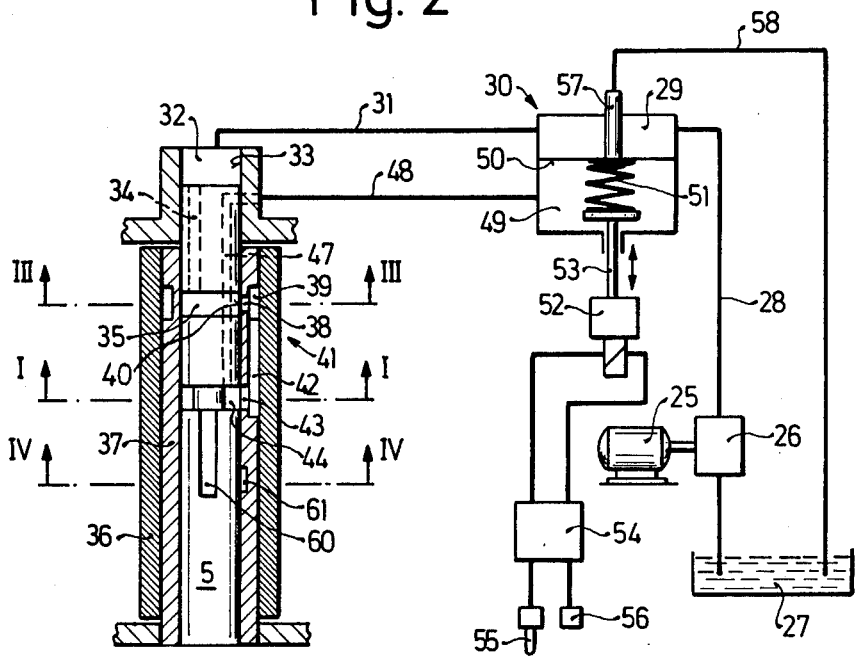
FIG. 2 is a top view of the fuel injection system according to the invention.
Figure 3:
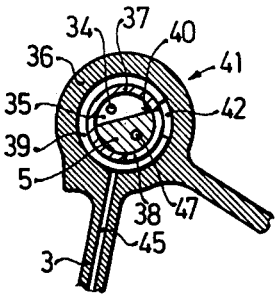
FIG. 3 is a section of the system taken along the line III—III in FIG. 2.

Turning now to FIG. 2, it will be seen that fuel is supplied to the system by an electric motor 25 which drives a fuel pump 26 that aspirates fuel from a fuel container 27 and delivers it via a line 28 to a chamber 29 within a differential pressure valve 30. From the chamber 29, fuel flows through a line 31 into a chamber 32 which is defined by the end face of the bearing shaft 5 and its guide bore 33 in an extension of the induction tube wall. A bore 34, shown in broken lines in FIG. 2, establishes communication of the chamber 32 with a groove 35 worked into the bearing shaft 5. The throttle element 3 is affixed on a sleeve 36 which is fixedly attached to a bushing 37 rotating on the bearing shaft 5. The bushing 37 has a control slot 38 terminating in an annular groove 39. The control slot 38 cooperates with a control edge 40 (see FIG. 3) which is formed by the end surface of the groove 35 in the bearing shaft. Depending on the position of the throttle element 3, the control edge 40 opens the control slot 38 to varying degrees for metering out a fuel quantity proportional to the aspirated air flow rate. Thus, the control edge 40 and the control slot 38 together form a fuel metering valve 41 within the bearing shaft 5 of the throttle element 3. The metered fuel flows from the annular groove 39 through a groove 44 in the bearing shaft 5. The annular groove 44 communicates with a line 45 disposed within the baffle portion of the throttle element 3 and the line 45 opens at the terminal surface of the metering plate through an injection nozzle 46 into a gap 6 formed between the throttle element 3 and the wall of the induction tube 2 upstream of the narrow gap 6, as best seen in FIG. 1. In a variant embodiment, which is not illustrated, the line 45 might terminate in several nozzles 46 located in the end surface of the throttle element 3. As another variant, the injection nozzle 46 might be a slit extending nearly over the entire width of the end surface of the throttle element 3. In yet another embodiment, not illustrated, the injection nozzle 46 might be a fuel injection valve.

Fuel is metered out at the metering valve 41 with constant pressure difference. For this purpose, the annular groove 44 communicates through a bore 47 and a line 48 with a chamber 49 in the differential pressure valve 30 which is separated by a diaphragm 50 from the chamber 29. The differential pressure valve 30 is urged to close by a spring 51 within the chamber 49. The force of the spring 51 may be changed in dependence on operational parameters of the engine. For this purpose, an electromagnet 52 may, for example, be employed, which engages the spring 51 via an actuating pin 53, or, again, a supplementary force whose magnitude depends on engine variables may act directly on the diaphragm 50 in parallel with the spring 51. For example, the magnet 52 may be actuated by an electronic controller 54, in response to signals from an oxygen sensor 55 located in the exhaust line or from a temperature sensor 56. The force on the diaphragm 50 might also be made dependent on a bimetallic spring which engages the spring with a force depending on the engine temperature. The differential pressure valve 30 is embodied as a flat seat valve whose diaphragm 50 is its movable valve member which cooperates with a fixed valve seat 57 over which fuel may flow into a return line 58 which terminates in the fuel container 27. The differential pressure valve serves at the same time as a system pressure control valve.

The basic setting of the fuel metering valve 41 may be adjusted by rotating the bearing shaft 5 with respect to the throttle element.

Figure 4:
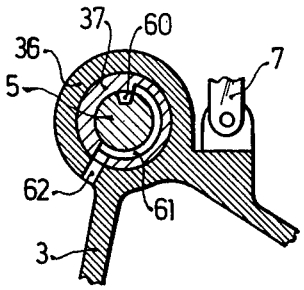
FIG. 4 is a section of the system taken along the line IV—IV in FIG. 2.

A very favorable feature of the invention is that the metered-out fuel is mixed with air prior to injection in the air induction tube. For this purpose, as shown more clearly in FIG. 4, the annular groove 44 communicates with an air hole 62 via a groove 60 and an annular groove 61. The air hole 62 leads to the interior of the air induction tube 1 upstream of the throttle element 3. The annular groove 61 is preferably so embodied that it covers the groove 60 only when the engine runs at least a minimum idling rpm. This feature prevents the admission of an incombustible fuel-air mixture during engine start up. The admixture of air to the metered fuel prior to injection in the induction tube results in an improved mixture preparation.

The above-described fuel injection system according to the present invention operates as follows.

When the engine is running, the fuel pump 26 aspirates fuel from the container 27 and delivers it through the line 28 to the fuel metering valve assembly 41. At the same time, the engine aspirates air which flows through the induction tube 1 and the flow aperture 6. Depending on the displacement of the throttle element 3 by the accelerator pedal linkage, the control slot 38 is opened to a higher or lower degree by the control edge 40. Since the fuel metering valve 41 is controlled directly by the position of the throttle element 3, the sonic velocity at the narrowest flow aperture 6 insures that the ratio of aspirated air and metered-out fuel is constant. Furthermore, the fuel metering takes place at a pressure difference which is held constant by the differential pressure valve 30 while the force of the spring 51 and, hence, the pressure difference, may be changed so as to adapt the fuel-air ratio to different operational conditions of the engine. The metered-out fuel is injected through the injection nozzle 46 located at the end surface of the throttle element 3 upstream of the narrowest flow aperture 6, i.e., near a point where the air flow has its highest velocity, so as to obtain as homogeneous a fuel-air mixture as possible.

The fuel injection system according to the present invention provides the advantage that the location of the fuel metering assembly 41 in the bearing shaft 5 makes possible a very compact construction and, furthermore, since the fuel injection occurs through the end surface of the throttle element 3, all fuel lines may be made very short and a very good mixture integration is obtained. Yet another improvement of the fuel mixture preparation results from admixing air with the metered-out fuel prior to injection in the induction tube.

As long as sonic velocity prevails in the narrowest flow cross section 6, the static pressure sensed at the opening 14 and transmitted to the chamber 16 is so low that the force produced by the induction tube pressure upstream of the throttling element 3 which is exerted on the diaphragm 19 overcomes the force of the spring and the force due to the static pressure. Therefore, the diaphragm attaches to the stop ring 22. Under these conditions the throttling element is displaced exclusively by the accelerator pedal 10.

If the throttle element 3 is moved far enough in the counterclockwise sense, the static pressure prevailing in the narrowest flow cross section 6 rises substantially above that prevailing at sonic velocity. As a consequence, the diaphragm 19 is lifted off from the stop ring 22 and actuates the arm 20 which thereby displaces the bearing point 21 of the lever 8 so that the throttle element 3 is rotated clockwise by the lever 8 until the flow velocity in the narrowest flow cross section 6 is again that defined by the force of the spring 18. Thus, the lower the force of the spring 18, the richer will be the mixture under these conditions. Hence, by an appropriate choice of the tension of spring 18 exerted on the diaphragm 19, the desired full-load enrichment of the fuel-air mixture may be chosen.

For example, if the opening 14 in the throttle element 3 is itself a throttle, an automatic mixture enrichment may be achieved during a transition from a closed throttle element to a rapidly opened throttle element.

The fuel supply system according to the invention offers the advantage that no separate throttle flap is necessary downstream of the point of fuel injection and this is an advantageous feature inasmuch as the fuel-air mixture could undergo decomposition at an additional throttle valve if it were present.

Figure 5:
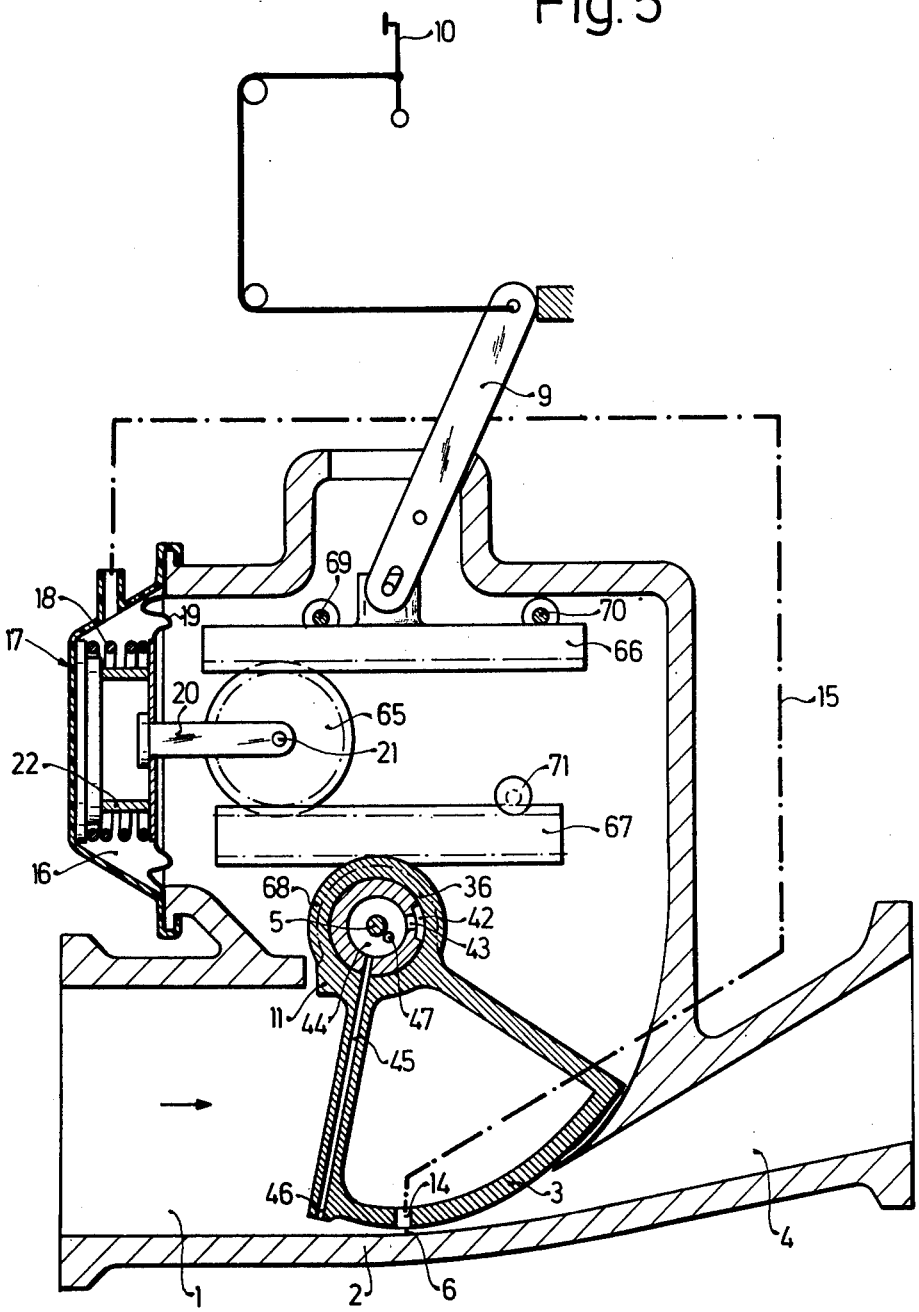
FIG. 5 is a section through a second exemplary embodiment of the invention taken along the line I—I in FIG. 2.

The second embodiment of the invention illustrated in FIG. 5 differs from that illustrated in FIGS. 1–4 only by the different linkage between the accelerator pedal 10 and the throttle element 3 which, in this case is a rack and pinion drive. In this embodiment, the actuating arm 20 coupled to the pressure cell 17 is provided with a gear 65 which engages a first rack 66 that is actuated by the accelerator pedal, and also engages a second rack 67 which, in turn, is coupled to gear teeth provided on the throttle element 3. The first rack 66 is held and guided by two rollers 69 and 70 and the second rack 67 is guided by a gear 71.

The function of the rack and pinion drive 65, 66, 67, 68 is as follows. When the accelerator pedal is moved from the idling position, the lever 9 causes a displacement of the first rack 66 and thereby induces a rotation of the gear 65. As a consequence, the second rack 67 engaging the gear 65 moves the throttle element 3 via the gear teeth 68. As long as sonic velocity prevails in the narrowest flow aperture 6, the pressure difference exerted on the diaphragm 19 overcomes the force of the spring 18 within the pressure cell 17 and, as previously described, the diaphragm 19 attaches to the stop ring 22. Thus the pivot point 21 of the gear 65 on the actuating arm 20 may be considered to be fixed with respect to the housing. If the throttle element 3 is now opened further by the accelerator pedal 10 until the latter is in its full load position, the vacuum in the narrowest flow aperture declines to nearly zero. Since the pressure difference exerted on the diaphragm 19 is now very small, the spring 18 is capable of lifting the diaphragm 19 from the stop ring 22 and hence also lifts the actuating arm 20 coupled thereto. Since the first rack 66 is held fast by the accelerator pedal in the full-load position, the gear 65 rolls against the rack 66 and moves the second rack 67 in such a manner as to close the throttle element 3 again until the pressure difference exerted on the diaphragm 19 overcomes the force of the spring 18. Thus, a state of equilibrium is obtained and the choice of the tension of the spring 18 permits obtaining a predetermined enrichment of the mixture under full-load operation.

The foregoing description relates to preferred embodiments of the invention and many variants thereof are possible within the spirit and scope of the invention, the latter being defined by the appended claims.

What is claimed is:

1. In a fuel supply system for an internal combustion engine, said engine including an air induction tube, means for fuel injection into said induction tube, fuel metering means, a throttling element located in said induction tube and coupled to said fuel metering means to control fuel injection as a function of air flow through said induction tube, and an accelerator pedal, the improvement comprising:

a shaft mounted in said induction tube and having an axis transverse to the direction of air flow in said induction tube, said throttle element is a body disposed to pivot about said shaft, a surface of said body remote from said pivotal axis is substantially cylindrical and is adapted to cooperate with the interior wall of said induction tube to form therewith an air flow aperture of varying cross section, and said throttle element can be rotated by linkage attached to the accelerator pedal of the engine;

pressure means, responsive to the static air pressure prevailing in the vicinity of said air flow aperture, coupled to said throttle element, for independent displacement thereof;

said fuel metering means is constituted by said pivotal shaft and by portions of said throttle element cooperating therewith such that the magnitude of injected fuel depends on the relative position of said pivotal shaft and said throttle element which together define a fuel metering slot of variable size; and said means for fuel injection is a nozzle in said body located adjacent to said substantially cylindrical surface remote from said pivotal shaft, said nozzle being in fluid communication with said fuel metering slot; whereby fuel is injected into said induction tube at a location where the air flow velocity is a relative maximum.

2. A fuel injection system as defined by claim 1, wherein said throttle element and the interior wall of said induction tube are shaped in such a manner that the air flowing through said air flow aperture moves at sonic velocity.

3. A fuel injection system as defined by claim 2, wherein said pressure means includes a diaphragm which is coupled to said throttle element by an actuating arm, said diaphragm being in communication with induction tube pressure upstream of said throttle element on one side thereof and with static pressure in said air flow aperture on the other side thereof and further comprising a spring acting against the side of said diaphragm affected by static pressure in said flow aperture.

4. A fuel injection system as defined by claim 3, wherein the smallest flow cross section of said aperture may be reduced by rotation of said throttle element effected by said pressure means acting via said actuating arm when the static pressure prevailing in said air flow aperture is substantially higher than that prevailing when the air flow moves at sonic velocity.

5. A fuel injection system as defined by claim 4, wherein the means for transmitting motion from the accelerator pedal of the engine to the throttle element in the induction tube is a system of levers.

6. A fuel injection system as defined by claim 4, wherein the means for transmission of motion from the accelerator pedal of the engine to the throttle element in the induction tube is a system of racks and pinions.

7. A fuel injection system as defined by claim 6, wherein said actuating arm connected to said pressure means is provided with a gear and wherein said fuel injection system further includes a first rack actuatable by the accelerator pedal of the engine and engaged by said gear and further includes a second rack slidably disposed in said induction tube and also engaged by said gear and wherein said throttle element is provided with gear teeth engaging said second rack.

8. A fuel injection system as defined by claim 1, further comprising a differential pressure valve for maintaining constant pressure across the fuel metering valve.

9. A fuel injection system as defined by claim 8, wherein the pivotal shaft of the throttle element is provided with a control edge and wherein said throttle element is provided with a bushing rotating about said shaft, said bushing having a slit cooperating with said control edge for metering out fuel to the internal combustion engine depending on the rotation of said throttle element.

10. A fuel injection system as defined by claim 9, including means in said throttle element for admitting air to the fuel downstream of the fuel metering means but upstream of said fuel injection means, said means for admitting air being coupled to the air induction tube of the engine upstream of said throttle element.

11. A fuel injection system as defined by claim 10, wherein said means for admitting air is obturated when the engine is started.

12. A fuel injection system as defined by claim 10, wherein said means for fuel injection includes at least one injection nozzle.

13. A fuel injection system as defined by claim 10, wherein said means for fuel injection is a fuel injection valve.

14. A fuel injection system as defined by claim 1, further comprising a differential pressure valve for maintaining constant pressure across said fuel metering means, said differential pressure valve being a flat seat valve including a diaphragm and a spring, one side of said diaphragm experiencing fuel pressure upstream of said fuel metering valve and the other side experiencing fuel pressure downstream of said fuel metering valve and the force of said spring.

15. A fuel injection system as defined by claim 14, further comprising means for changing the force of said spring in dependence of operational engine variables.

16. A fuel injection system as defined by claim 15, wherein said differential pressure valve serves to maintain the overall fuel pressure in said fuel injection system.

* * * * *